US005643181A

United States Patent [19]

Lin

[11] Patent Number: 5,643,181

[45] Date of Patent: Jul. 1, 1997

[54] MULTIPURPOSE MASSAGING APPARATUS

[76] Inventor: Kenny Lin, 7F, No. 11, Lane 93, Tai-Lin Road, Sec. 2, Tai-Shan Hsiang, Taipei Hsien, Taiwan

[21] Appl. No.: 593,402

[22] Filed: Jan. 29, 1996

[51] Int. Cl.[6] ..... A61H 15/00

[52] U.S. Cl. ..... 601/112; 601/115; 601/127; 601/128; 601/131; 601/28

[58] Field of Search ..... 601/84, 112, 115, 601/116, 118, 119–126, 128–131, 127, 28

[56] References Cited

U.S. PATENT DOCUMENTS

| | | | |
|---|---|---|---|
| 4,660,548 | 4/1987 | Bucha | 601/61 |
| 4,782,823 | 11/1988 | Yamasaki | 601/127 |
| 5,099,826 | 3/1992 | Hayakawa | 601/61 |
| 5,445,595 | 8/1995 | Chou | 601/118 |

FOREIGN PATENT DOCUMENTS

| | | | |
|---|---|---|---|
| 403268757 | 11/1991 | Japan | 601/127 |
| 404102454 | 4/1992 | Japan | 601/127 |
| 406054885 | 3/1994 | Japan | 601/115 |

*Primary Examiner*—Danton D. DeMille

*Attorney, Agent, or Firm*—Beveridge, DeGrandi, Weilacher & Young, L.L.P.

[57] ABSTRACT

A multipurpose massaging apparatus which includes a housing having a top open chamber, a massaging barrel revolvably mounted within the top open chamber of the housing, a motor drive mounted inside the housing and controlled to turn the massaging barrel, a flexible cover fastened to the housing and covered over the rotary massaging elements of the massaging barrel, and two stands pivotably connected to the housing at the bottom side. Then stands support the apparatus on the ground for massaging the sole when they are extended out. The stands can be held in hand when collapsed, so that the apparatus can be moved to massage the body.

3 Claims, 6 Drawing Sheets

MULTIPURPOSE MASSAGING APPARATUS

BACKGROUND OF THE INVENTION

The present invention relates to massaging apparatus, and relates more particularly to a multipurpose massaging apparatus which can be supported on the ground for massaging the sole, or held in hand for massaging the body.

Various motor-driven massaging apparatus have been disclosed for massaging different parts of the body, and have appeared on the market. These motor-driven massaging apparatus commonly use a motor drive to turn a massaging barrel, which has movable massaging elements around the periphery. When the massaging barrel is rotated, the movable massaging elements are forced to rub against the legs or a part of the body being attached thereto. These motor-driven massaging apparatus are functional, however they are commonly heavy, not convenient for holding and moving by hand to massage different part of the body. Furthermore, these motor-driven massaging apparatus commonly have a cloth covering covered over the movable massaging elements of the massaging barrel. However, because this cloth covering is not detachable, it is not replaceable when damaged. If the cloth covering is dirty, the washing job is difficult to perform.

SUMMARY OF THE INVENTION

According to one aspect of the present invention, the multipurpose massaging apparatus comprises a housing having a top open chamber, a massaging barrel revolvably mounted within the top open chamber of the housing, a motor drive mounted inside the housing and controlled to turn the massaging barrel, a flexible cover fastened to the housing and covered over the rotary massaging elements of the massaging barrel, and two stands pivotably connected to the housing at the bottom side, wherein the stands support the apparatus on the ground for massaging the sole of the feet and/or the legs of a user when extended out; the stands can be held in hand when collapsed, so that the apparatus can be moved to massage the body.

According to another aspect of the present invention, the flexible cover comprises two elastic bands at two opposite side edges thereof respectively inserted into two arched grooves at two opposite ends of the top open chamber of the housing, and two mounting blocks at two opposite end edges thereof, the mounting blocks having a respective row of upright pins respectively fitted into respective pin holes on the housing. Therefore, the flexible cover can be conveniently detached from the housing for washing.

DETAILED DESCRIPTION OF THE PREFERRED EMBODIMENT

Figure 1:
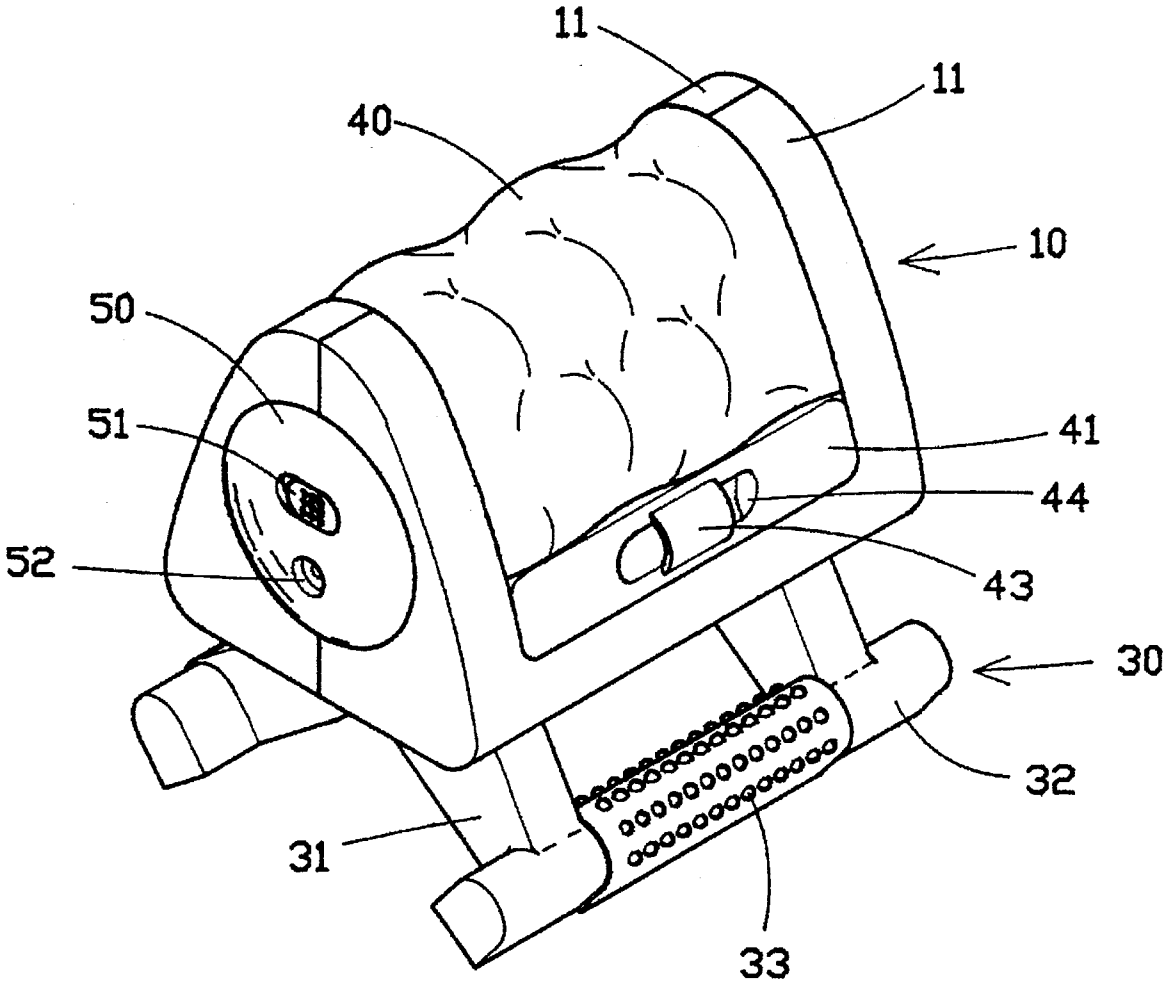
FIG. 1 is an elevational view of a multipurpose massaging apparatus according to the present invention.
Figure 2:
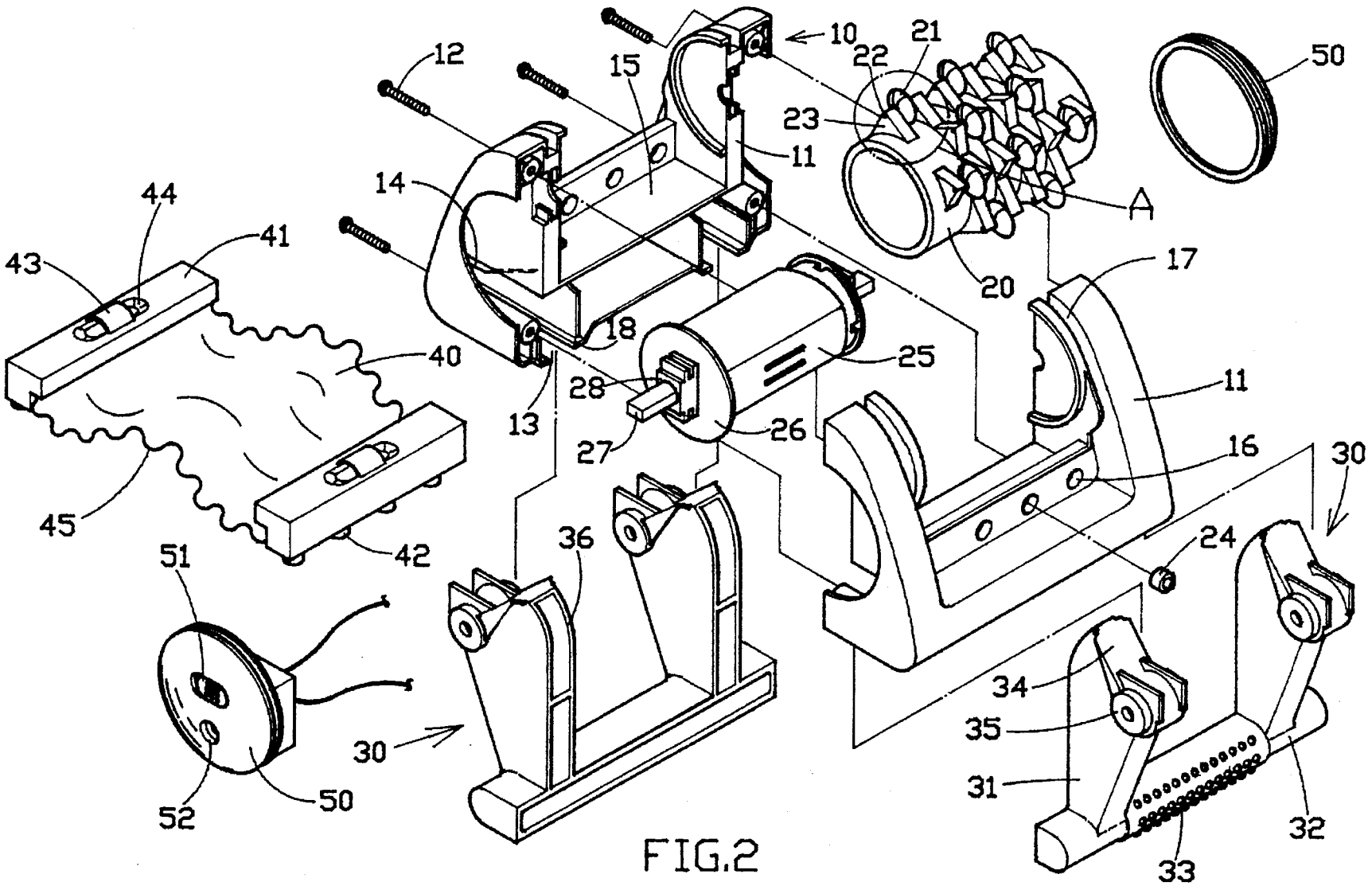
FIG. 2 is an exploded view of the multipurpose massaging apparatus shown in FIG. 1.
Figure 2A:
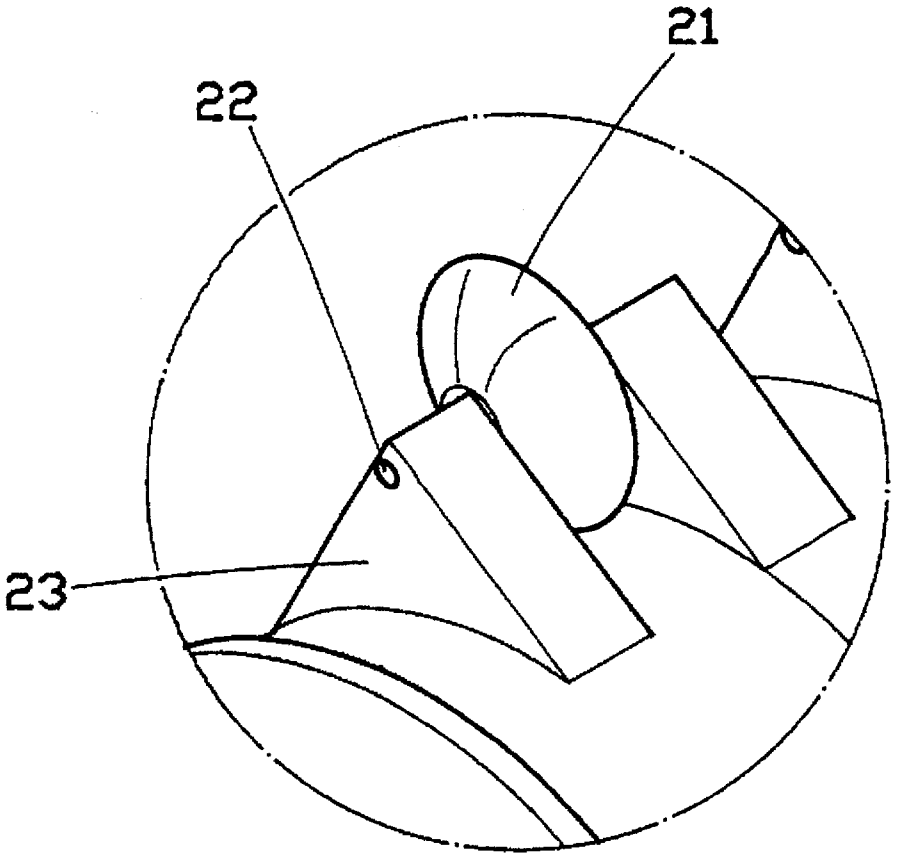
FIG. 2A is a partial view in an enlarged scale of FIG. 2, showing the rotary member turned about the pivot between between two triangular blocks.

Referring to FIGS. 1 and 2, a multipurpose massaging apparatus in accordance with the present invention is generally comprised of a housing 10, a massaging barrel 20, two stands 30, and a flexible cover 40.

Figure 3:
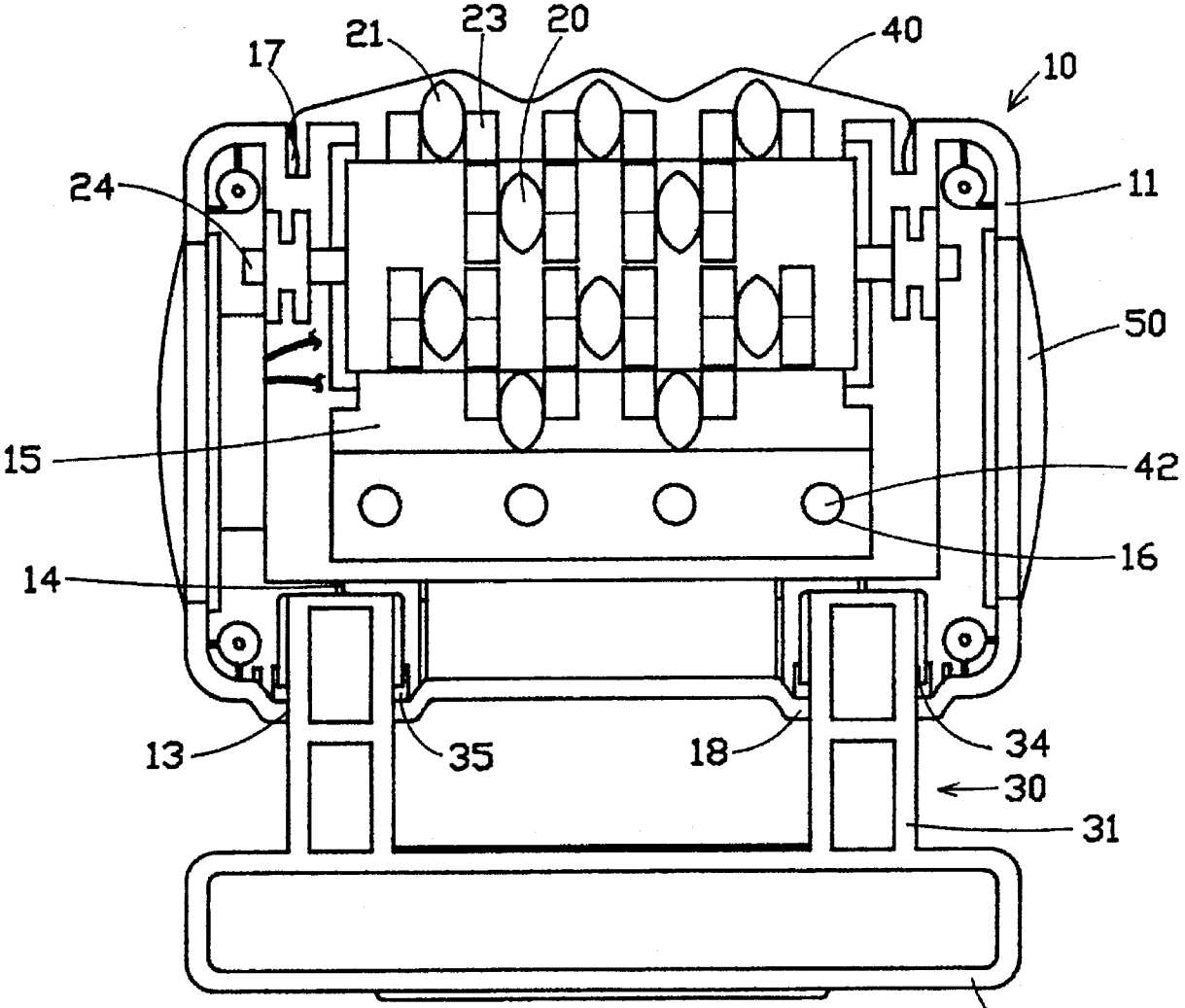
FIG. 3 is a front view in section of the multipurpose massaging apparatus shown in FIG. 1.
Figure 4:
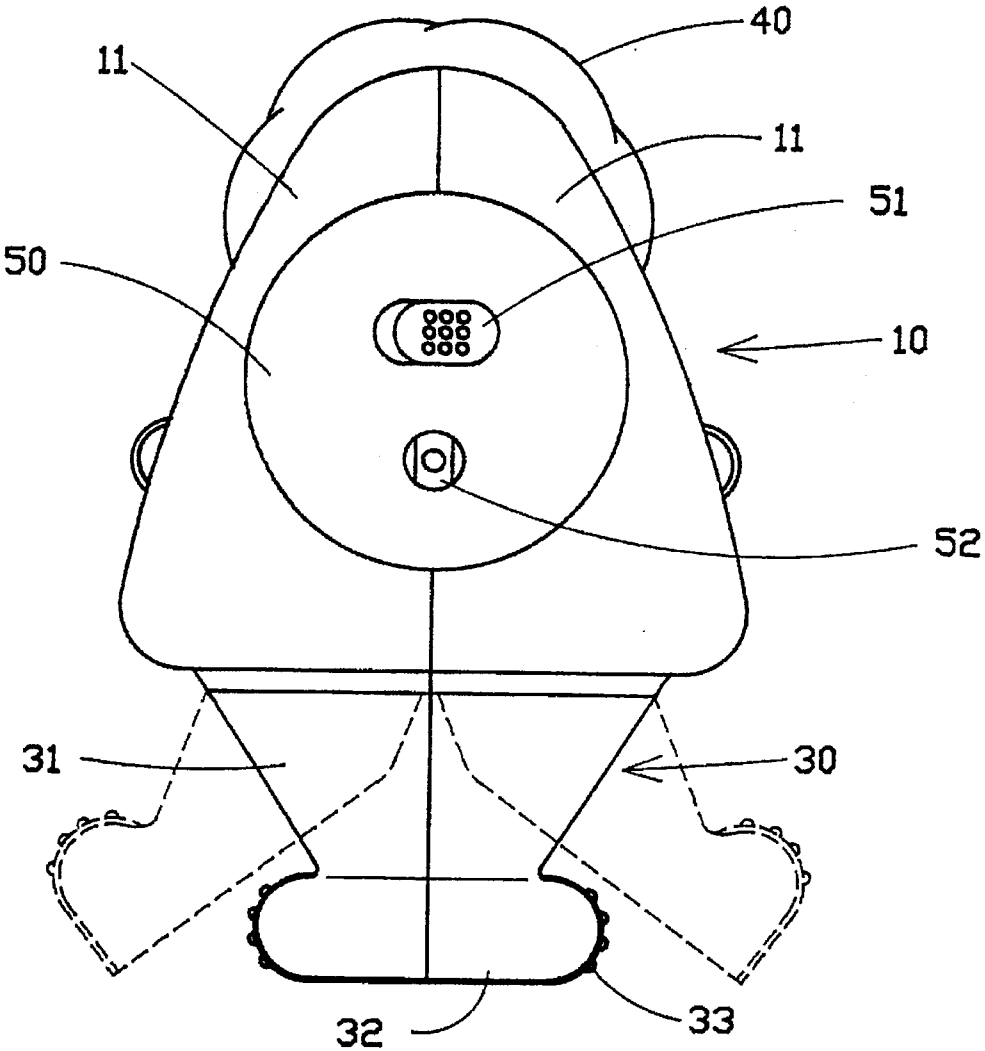
FIG. 4 is a side view of the multipurpose massaging apparatus shown in FIG. 1, showing the stands collapsed.
Figure 5:
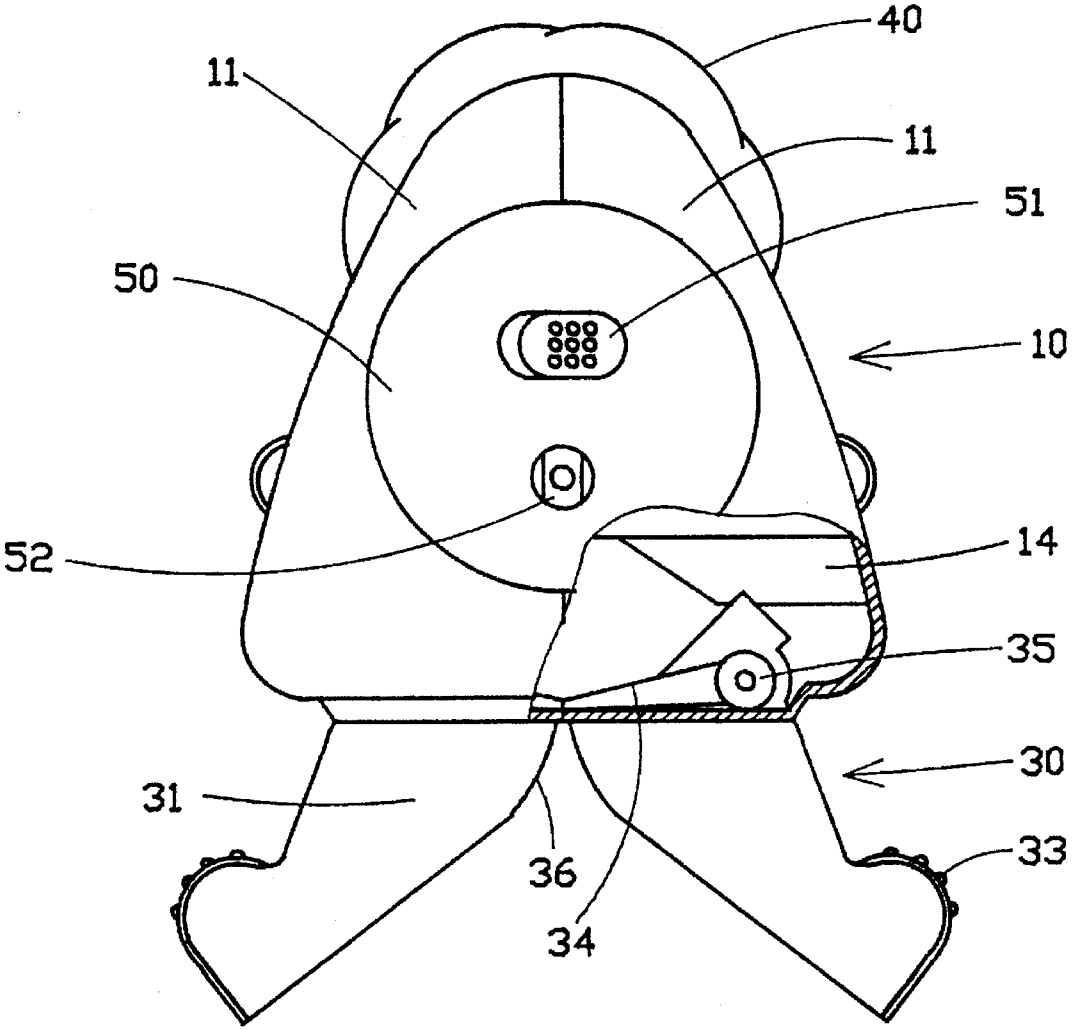
FIG. 5 is similar to FIG. 4 but showing the stands extended.

Referring to FIGS. 3, 4, and 5, and FIG. 1 again, the housing 10 is a substantially U-shaped container comprised of two symmetrical half shells 11 connected together by screws 12. The housing 10 comprises a top open chamber 15 for mounting the massaging barrel 20, two elongated bottom holes 13 for mounting the stands 30, two projecting blocks 14 at two opposite lateral sides outside the bottom holes 13, two rows of pin holes 16 horizontally disposed at the front and back sides and two smoothly curved grooves 17 at two opposite ends of the top open chamber 15 for mounting the flexible cover 40, and two pairs of flanges 18 respectively disposed along two opposite sides of the bottom holes 13.

The massaging barrel 20 is mounted within the top open chamber 15 of the housing 10, having pairs of triangular blocks 23 raised from the periphery, a plurality of pivots 22 respectively and horizontally mounted in each pair of triangular blocks 23, and a plurality rotary elements 21 respectively turned about the pivots 22 and partially protruding over the respective pairs of triangular blocks 23. The massaging barrel 20 has a motor 25 fixedly mounted on the inside. The motor 25 has a motor shaft 27 extending out two opposite ends 26 thereof and inserted through two mounting blocks 28, which secure the motor 25 with the massaging barrel 20 to the housing 10 inside the top open chamber 15. When the motor 25 is started, it is forced to rotate on the motor shaft 27, therefore the massaging barrel 20 is simultaneously rotated within the top open chamber 15.

The stands 30 are symmetrically mounted in the bottom holes 13 of the housing 10, each comprised of an elongated horizontal base 32 and two parallel connecting bars 31 perpendicularly raised from the base 32 for connection to the bottom holes 13 of the housing 10. The horizontal base 32 can be stably supported on the ground, having a plurality of raised portions 33 over the periphery for grasping positively. Each of the connecting bars 31 has a slope 34 and an arched portion 36 disposed at the top in reversed direction, and a pivot 35 at the bottom end of the top slope 34. When the connecting bars 31 of each stand 30 are respectively mounted in the bottom holes 13 of the housing 10, the pivots 35 of the connecting bars 31 are respectively supported between the flanges 18 at two opposite sides of each bottom hole 13, permitting the stands 30 to be turned between the collapsed position and the extended position. When the stands 30 are extended out, the arched portions 36 of one stand 30 are respectively stopped against the arched portions 36 of the other, and therefore the stands 30 are maintained firmly in the extended position (see also FIG. 8). When the stands 30 are collapsed, the slopes 34 of the connecting bars 31 are respectively stopped against the projecting blocks 14, and the bases 32 of the stands 30 are abutted against each other (see FIG. 4).

The flexible cover 40 is fastened to the housing 10 and covered over the massaging barrel 20. Preferably, the flexible cover 40 is made from cloth, having two elastic bands 4B fastened to two opposite side edges thereof, and two mounting blocks 41 fixedly and transversely secured to two opposite end edges thereof. Each of the mounting blocks 41 has a row of upright pins 42 at the top side, a recessed hole 44 at the bottom side in the middle, a handle 43 over the recessed hole 44 for the grasping with the hand. The flexible cover 40 is installed by: inserting the elastic bands 45 into the smoothly curved grooves 17 of the housing 10 respectively, then fitting the pins 42 of the mounting blocks 41 into the pin holes 16 of the half shells 11 of the housing 10 respectively. Furthermore, a press button type safety switch 24 is mounted in one pin hole 16 of the housing 10. When the pins 42 of the flexible cover 40 are respectively fitted into the pin holes 16 of the housing 10, the press button type safety switch 24 is switched on. On the contrary, when the flexible cover 40 is disconnected from the housing 10, the safety switch 24 is switched off to cut off the circuit. Furthermore, two end caps 50 are respectively fastened to the projecting blocks 14. One end cap 50 has an on/off switch 51 connected to the motor 25 through the safety switch 24, and a power input socket 52 connected to the on/off switch 51 for connection to power supply.

Referring to FIG. 4 again, the stands 30 are collapsed and closely attached together for use as a handle, so that the user can hold the bases 32 of the stands 30 to move the flexible cover 40 (which is covered over the rotary massaging elements 21 of the massaging barrel 20) over the body when the on-off switch 51 is switched on.

Referring to FIG. 5 again, when the stands 30 are extended out, the massaging apparatus can be put on the ground, and the legs can be rested on the flexible cover 40. When the on/off switch 51 is switched on, the massaging barrel 20 is rotated, causing the rotary massaging elements 21 to rub over the flexible cover 40 against the soles of the feet and/or the legs.

While only one embodiment of the present invention has been shown and described, it will be understood that various modifications and changes could be made without departing from the spirit and scope of the invention disclosed.

What the invention claimed is:

1. A multipurpose massaging apparatus comprising:

a housing, said housing comprising two symmetrical half shells connected together by screws, having a top open chamber, two opposite bottom holes, two projecting blocks at two opposite lateral sides outside said bottom holes, and two end caps respectively mounted on said projecting blocks;

a rotatable massaging barrel mounted in said top open chamber of said housing, said massaging barrel comprising pairs of triangular blocks raised from the periphery, a plurality of pivots respectively and horizontally mounted in each pair of triangular blocks, and a plurality of rotary elements respectively rotated about said pivots of said massaging barrel;

a motor for driving said massaging barrel in rotation in said top open chamber of said housing;

an electrical socket mounted in one of said two end caps of said housing for connection to a power supply;

an on/off switch mounted on said one of said two end cads of said housing and electrically connected to said motor and said electrical socket;

a flexible cover mounted on said housing and covering said rotary elements of said massaging barrel; and two stands respectively mounted in said bottom holes of said housing and movable relative to each other between a collapsed position, in which said two stands are close together to allow said massaging apparatus to be hand held, and an extended position, in which said two stands are spatially disposed to support said massaging apparatus on a surface, each of said two stands comprising an elongated horizontal base and two parallel connecting bars perpendicularly extending from said base, each connecting bar having a top end inserted into one of said two opposite bottom holes of said housing and rotatable about a respective pivot axis, said top end of each of said two parallel connecting bars having a slope and an arched portion at two opposite sides, said arched portion of said connecting bars of one of said two stands being stopped against said arched portion of the other of said two stands when said stands are moved to said extended position, said slopes of said connecting bars of said two stands being respectively stopped against said two projecting blocks of said housing and said elongated horizontal bases thereof being abutted against each other when said two stands are moved to said collapsed position.

2. The multipurpose massaging apparatus of claim 1 wherein said housing further comprises a horizontal row of pin holes on each of said two symmetrical half shells, and two arched grooves, each of said two arched grooves disposed at one of two opposite ends of said top open chamber, said flexible cover further includes an elastic band on each of two opposite side edges thereof respectively inserted into said two arched grooves of said housing, and a mounting block at each of two opposite end edges thereof, each of said mounting blocks having a row of upright pins releasably engaging said pin holes of said housing.

3. The multipurpose massaging apparatus of claim 2 further comprising a safety switch mounted in one pin hole of said housing, said safety switch being switched off to cut off the circuit between said motor drive and said on/off switch when the pins of the mounting blocks of said flexible cover are released from said pin holes of said housing.

* * * * *